US008608465B2

(12) United States Patent
Sexton

(10) Patent No.: US 8,608,465 B2
(45) Date of Patent: Dec. 17, 2013

(54) POSITIVE-DISPLACEMENT ROTARY PUMP HAVING A POSITIVE-DISPLACEMENT AUXILIARY PUMPING SYSTEM

(75) Inventor: Jason M. Sexton, Aurora, IL (US)

(73) Assignee: Peopleflo Manufacturing, Inc., Franklin Park, IL (US)

( * ) Notice: Subject to any disclaimer, the term of this patent is extended or adjusted under 35 U.S.C. 154(b) by 0 days.

(21) Appl. No.: 13/528,343

(22) Filed: Jun. 20, 2012

(65) Prior Publication Data

US 2013/0004357 A1 Jan. 3, 2013

Related U.S. Application Data

(60) Provisional application No. 61/503,423, filed on Jun. 30, 2011.

(51) Int. Cl.

| | |
|---|---|
| ***F01C 1/10*** | (2006.01) |
| ***F01C 1/344*** | (2006.01) |
| ***F01C 21/04*** | (2006.01) |
| ***F01C 21/06*** | (2006.01) |
| ***F01C 19/08*** | (2006.01) |
| ***F01C 1/18*** | (2006.01) |
| ***F04C 2/10*** | (2006.01) |
| ***F04C 2/344*** | (2006.01) |
| ***F04C 18/10*** | (2006.01) |
| ***F04C 18/344*** | (2006.01) |
| ***F04C 15/06*** | (2006.01) |
| ***F04C 29/02*** | (2006.01) |
| ***F04C 29/04*** | (2006.01) |
| ***F04C 2/18*** | (2006.01) |
| ***F04C 18/18*** | (2006.01) |

(52) U.S. Cl.

USPC ..... 418/15; 418/100; 418/130; 418/131; 418/170; 418/189; 418/205; 418/206.4; 418/206.6; 418/206.7; 418/206.8; 418/259; 418/268; 418/DIG. 1

(58) Field of Classification Search

USPC ..... 418/15, 170, 83, 86, 89, 99, 100, 104, 418/130, 131, 189, 191, 205, 206.3, 206.4, 418/206.6, 206.7, 206.8, 259, 268, DIG. 1, 418/228, 229, 230

See application file for complete search history.

(56) References Cited

U.S. PATENT DOCUMENTS 2,620,968 A * 12/1952 Nilsson ..... 418/15
3,174,408 A * 3/1965 Miller ..... 418/206.6

(Continued)

OTHER PUBLICATIONS

PCT International Prelimiary report on Patentability (Chapter II of the PCT) written opnion for PCT/US2012/043438, dated Jul. 11, 2013.*

(Continued)

*Primary Examiner* — Mary A Davis
(74) *Attorney, Agent, or Firm* — Cook Alex Ltd.

(57) ABSTRACT

Positive-displacement auxiliary pumping systems for use in pump apparatus of different configurations are disclosed. The positive-displacement auxiliary pumping systems are included in positive-displacement rotary pumps having a casing defining a pumping cavity, an inlet port connected to the pumping cavity, a discharge port connected to the pumping cavity, and a positive-displacement auxiliary pumping port connected to the pumping cavity. Pumping elements move within the pumping cavity of the casing and define a collapsing pocket that maintains fluid communication with the positive-displacement auxiliary pumping port after the collapsing pocket is no longer in fluid communication with the discharge port.

12 Claims, 7 Drawing Sheets

(56) References Cited

U.S. PATENT DOCUMENTS

| | | | | | |
|---|---|---|---|---|---|
| 3,267,862 | A | * | 8/1966 | Mosbacher | 418/15 |
| 3,459,275 | A | * | 8/1969 | Seyfarth et al. | 418/206.4 |
| 3,904,333 | A | | 9/1975 | Stoeckelmann | |
| 4,165,206 | A | | 8/1979 | Martin et al. | |
| 4,342,537 | A | | 8/1982 | Goyne | |
| 4,659,296 | A | | 4/1987 | Bristow | |
| 5,263,818 | A | * | 11/1993 | Ito et al. | 418/15 |
| 6,106,250 | A | | 8/2000 | Morita et al. | |
| 2002/0008061 | A1 | | 1/2002 | Kossik et al. | |
| 2004/0253135 | A1 | | 12/2004 | Bohr | |

OTHER PUBLICATIONS

International Search Report for PCT/US2012/043438 dated Sep. 7, 2012.

Written Opinion of the International Searching Authority for PCT/US2012/043438 dated Sep. 7, 2012.

* cited by examiner

POSITIVE-DISPLACEMENT ROTARY PUMP HAVING A POSITIVE-DISPLACEMENT AUXILIARY PUMPING SYSTEM

CROSS-REFERENCE TO RELATED APPLICATION

This application claims the benefit of U.S. Provisional Patent Application Ser. No. 61/503,423, filed Jun. 30, 2011, the disclosure of which is hereby incorporated by reference in its entirety.

BACKGROUND OF THE INVENTION

1. Field of the Invention

The present invention generally relates to positive-displacement pumps, and more particularly to positive-displacement pumps that include an auxiliary pumping system that provides an auxiliary stream of the pumped fluid.

2. Discussion of the Prior Art

In many pumping applications, it is desirable to have an auxiliary stream of the pumped fluid to provide cooling and/or lubrication within a pump. Such an auxiliary stream may be used for cooling and/or lubrication of dynamic seals, whether packing or mechanical face seals, or of bearings or bushings, or cooling within separation canisters in magnetically-coupled pumps. However, it is common for such pumping systems to have the auxiliary stream driven by differential pressure.

Systems using differential pressure include a passageway between two locations within a pump. For instance, the pressure is higher in the first location than in the second location. Thus, it may simply be a passageway through a pump casing with the first location being in the pumping chamber behind the rotor, where the pressure is relatively high, while the second location is in the suction port chamber, where the pressure is relatively lower. Alternative systems can be much more complex and include several apertures, grooves, tubes and/or other passageways through multiple pump components, whether entirely within or even running externally of the pump casing.

The prior art auxiliary pumping systems that use differential pressure to move the fluid suffer from numerous disadvantages. The flowrate in such systems is strongly dependent on the differential pressure of the pump. Thus, the flowrate is very low when the differential pressure is very low, even though often the need for fluid flow for cooling or lubrication does not diminish with reduced differential pressure. Similarly, the flowrate of these auxiliary systems is strongly dependent on the viscosity of the pumped fluid. Therefore, the flowrate is very low when the viscosity is high, even though the need for fluid flow for cooling or lubrication does not diminish with increased viscosity. The differential pressure systems also are prone to clogging if the fluid contains solids or accumulations of thickened fluid. Clogging can completely disable the function of the auxiliary pumping stream.

There is at least one prior art system that utilizes an oscillating displacement system that does not produce continuous flow. The system is used in an internal gear pump, with a hole in the idler gear, in a root area between teeth. During most of the angle of rotation of the idler gear, the hole is exposed to either suction or discharge pressure and flow can move based on differential pressure, similar to the movement in the above-mentioned prior art devices. However, when the rotor and idler teeth mesh, they close off the chamber and compress it, and during this short time, flow is forced into the hole in a positive-displacement manner. The oscillation occurs because when the teeth begin to unmesh, the chamber expands and pulls fluid back out of the hole, thus momentarily reversing the flow.

Such oscillating systems include disadvantages. The oscillating nature of the system means that the same fluid is moved back and forth, with less new fluid being introduced. As such, these systems do not have the capacity to produce significant cooling effects. Compounding this problem, the rapid oscillation also only moves a very small volume of fluid per displacement.

The present invention addresses shortcomings in prior art pumping systems, while providing positive-displacement auxiliary pumping systems that provide an auxiliary pumping stream for use in enhanced cooling and/or lubrication.

SUMMARY OF THE INVENTION

The purpose and advantages of the invention will be set forth in and apparent from the description and drawings that follow, as well as will be learned by practice of the claimed subject matter.

The present disclosure generally provides a positive-displacement rotary pump having a casing defining a pumping cavity, an inlet port connected to the pumping cavity, a discharge port connected to the pumping cavity, a positive-displacement auxiliary pumping port connected to the pumping cavity, and pumping elements that move within the pumping cavity of the casing and define a collapsing pocket that maintains fluid communication with the positive-displacement auxiliary pumping port after the collapsing pocket is no longer in fluid communication with the discharge port.

The unique configuration of having an auxiliary pumping port positioned sufficiently proximate the discharge port permits the auxiliary pumping port to remain in fluid communication with the collapsing pocket immediately following the discontinuation of fluid communication between the collapsing pocket and the discharge port. It is contemplated that this configuration may be utilized in various positive-displacement rotary pumps, such as pumps of the types including, but not limited to, sliding vane, internal gear, lobe, external gear, gerotor, flexible vane and circumferential piston. The auxiliary pumping system also will work regardless of the direction the pump is turning, such that when rotating in one direction, the system will be based on positive-displacement of fluid that is forced under pressure through an auxiliary pumping port, while when rotating in the opposite direction, the fluid will be drawn by suction through the auxiliary pumping port.

The nature of the positive-displacement of the fluid through the auxiliary pumping port results in a flowrate of the fluid being substantially independent of the differential pressure of the pump and of the viscosity of the fluid. It also provides a system in which the passages through which the auxiliary pumping stream of fluid must pass are highly resistant to clogging because as a clog may begin to form, the nature of the positive-displacement of the fluid through the system will momentarily create higher pressure, which in turn will push the fluid and any clogging material through. Accordingly, the positive-displacement auxiliary pumping system eliminates many of the disadvantages of the auxiliary pumping stream systems in the prior art.

In another aspect of the disclosure, a positive-displacement pump may include an auxiliary pumping port that is connected to a conduit that is positioned external to the casing of the pump. The conduit may be connected at a first end to the auxiliary pumping port and at a second end to a further port on the casing. Furthermore, the conduit may be utilized to provide pumped fluid to something external to the pump itself, and in this manner, the single pump may be configured to provide the pumping of a first relatively large discharge pump and a second relatively small discharge pump.

Thus, the present disclosure presents an alternative to the prior art passive, pressure differential and active oscillating auxiliary pumping streams for lubrication and/or cooling of positive-displacement pumps, where the prior art systems have proven to be less effective than desired.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1A:
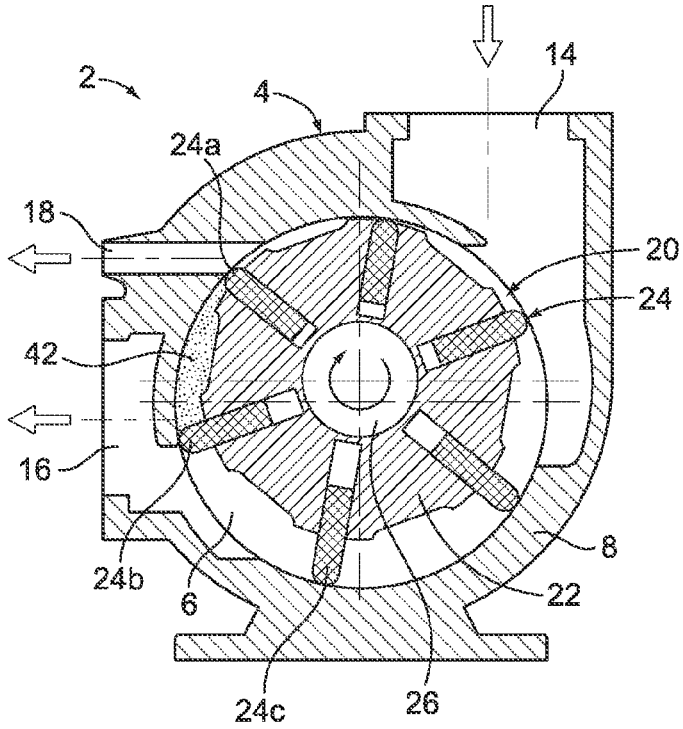
FIG. 1A is a cross-sectional view of a simplified version of a casing having a pumping cavity of a sliding vane pump that has a positive-displacement auxiliary pumping system, which is showing a collapsing pocket in fluid communication with an auxiliary pumping port, while the collapsing pocket is no longer in fluid communication with a discharge port.

It should be understood that the drawings are not to scale. While some mechanical details of a positive-displacement pump, including details of fastening means and other plan and section views of the particular components, have not been included, such details are considered well within the comprehension of those of skill in the art in light of the present disclosure. It also should be understood that the present invention is not limited to the example embodiments illustrated.

DETAILED DESCRIPTION OF THE PREFERRED EMBODIMENTS

Referring generally to FIGS. 1A-7B, it will be appreciated that a positive-displacement rotary pump having a positive-displacement auxiliary pumping system of the present disclosure generally may be embodied within numerous configurations of positive-displacement rotary pumps. Indeed, while acknowledging that all of the example configurations that may include the present positive-displacement auxiliary pumping system need not be shown herein, it is contemplated that the system may be incorporated into various positive-displacement rotary pumps, such as pumps of the types including, but not limited to, sliding vane, internal gear, lobe, external gear, gerotor, flexible vane and circumferential piston. To demonstrate this position, examples of pump configurations that relate to sliding vane, internal gear and lobe are shown herein.

Turning to a first example embodiment in FIGS. 1A, 1B, 2 and 3, a positive-displacement rotary pump 2 is shown having a casing 4 that remains stationary, relative to the movement of the pumping elements disposed within the casing 4. The casing 4 defines within its interior a pumping cavity 6. The pumping cavity 6 is generally located within a casing body 8 that is closed at respective ends by a casing front portion 10 and a casing rear portion 12. The casing components may be constructed of rigid materials, such as steel, stainless steel, cast iron or other metallic materials, or structural plastics or the like. The casing front portion 10 and casing rear portion 12 are sealingly connected to the casing body 8, such as by use of gaskets, O-rings or seals and/or fasteners, adhesives, welding or the like.

As best seen in FIG. 1A, the casing body 8 of the casing 4 includes an inlet port 14, a discharge port 16 and a positive-displacement auxiliary pumping port 18, all of which are connected to the pumping cavity 6, and in this embodiment, all of which are formed in the casing body 8 and positioned radially relative to the pumping cavity 6. However, one of skill in the art will appreciate that each of the ports 14, 16, 18 could be formed to cooperate via the casing body 8, the casing front portion 10 or the casing rear portion 12, and may be positioned radially or axially relative to the pumping cavity 6.

The example pump 2 also includes pumping elements 20 that are disposed within the pumping cavity 6, and which include a rotatable rotor 22 and a plurality of movable vanes 24, which may be constructed of any of a variety of rigid materials, and the materials typically are chosen based on the fluid to be pumped. It will be appreciated that pump 2 is a sliding vane pump in which the vanes 24 are radially slidable within the rotor 22, and such mounting may include configurations that assist the movement of the individual vanes 24, such as by use of centrifugal force, hydraulic actuation, push rod assemblies, or the like. However, the embodiments are shown in simplified form, so as to focus on the pumping principles and to avoid including structures that are not necessary to the disclosure and that would over complicate the drawings.

Figure 3:
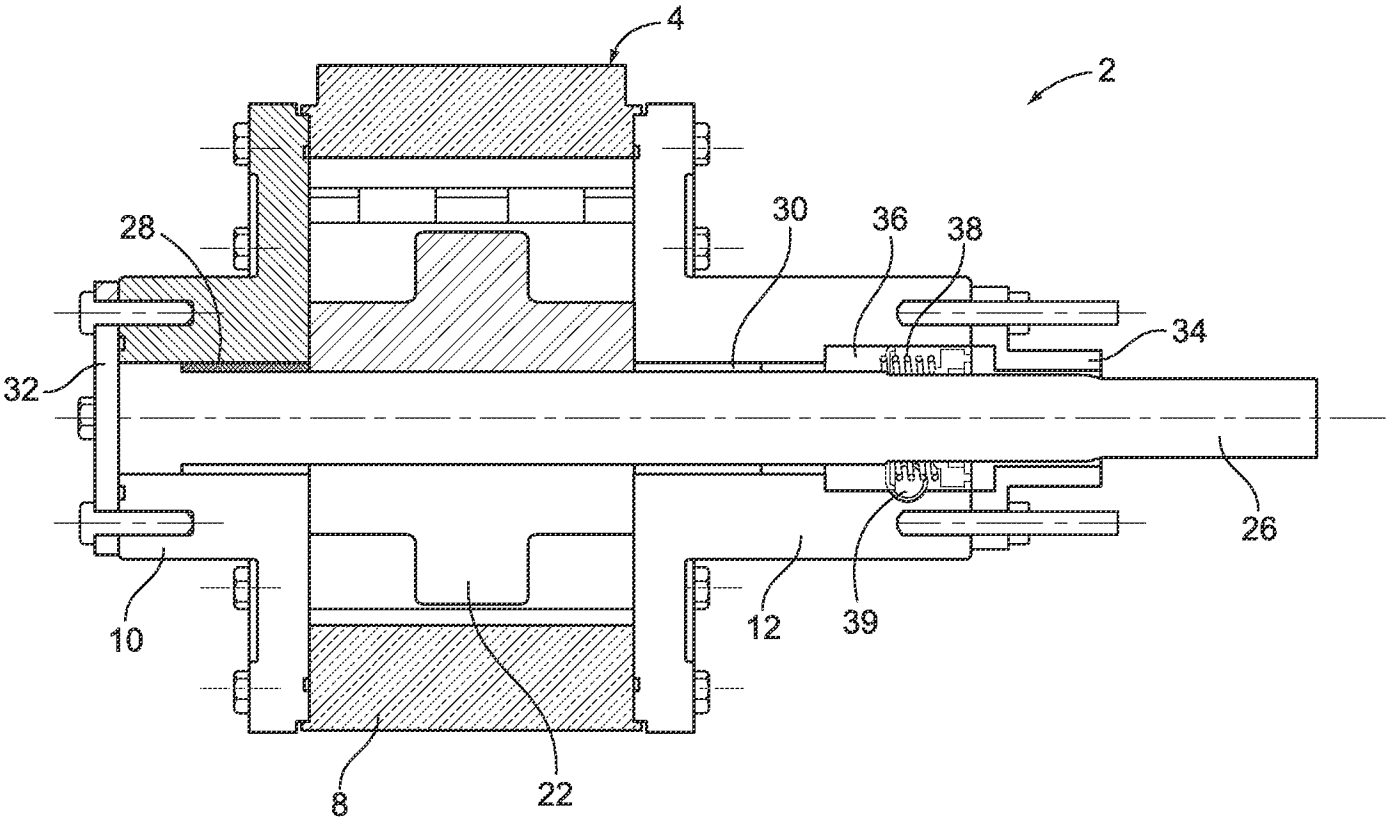
FIG. 3 is a cross-sectional view of the sliding vane pump of FIGS. 1A and 1B.

A simplified view of the remainder of the positive-displacement rotary pump 2 is shown in FIG. 3, where one can see that the rotor 22 is connected to a shaft 26. It will be appreciated that the shaft 26 may be rotatably supported by bearings, which could be in the form of ball or roller bearings or bushings, and which will be collectively referred to herein as bearings. In this example, the shaft 26 is rotatably mounted within the casing 4 by bearings 28 in the casing front portion 10 and by bearings 30 in the casing rear portion 12. The shaft 26 may be coupled at an end to an external power source (not shown), such as a motor or the like, to drive the rotation of the shaft 26.

As best seen in FIG. 3, the casing front portion 10 of the casing 4 is closed by a front cap 32, while the casing rear portion 12 of this example is closed by a mechanical seal cap 34. The casing rear portion 12 and mechanical seal cap 34 define a seal chamber 36 that encloses a seal in the form of a mechanical seal 38 that provides a dynamic seal between the shaft 26 and the casing rear portion 12, while being in fluid communication with a port 39.

Figure 2:
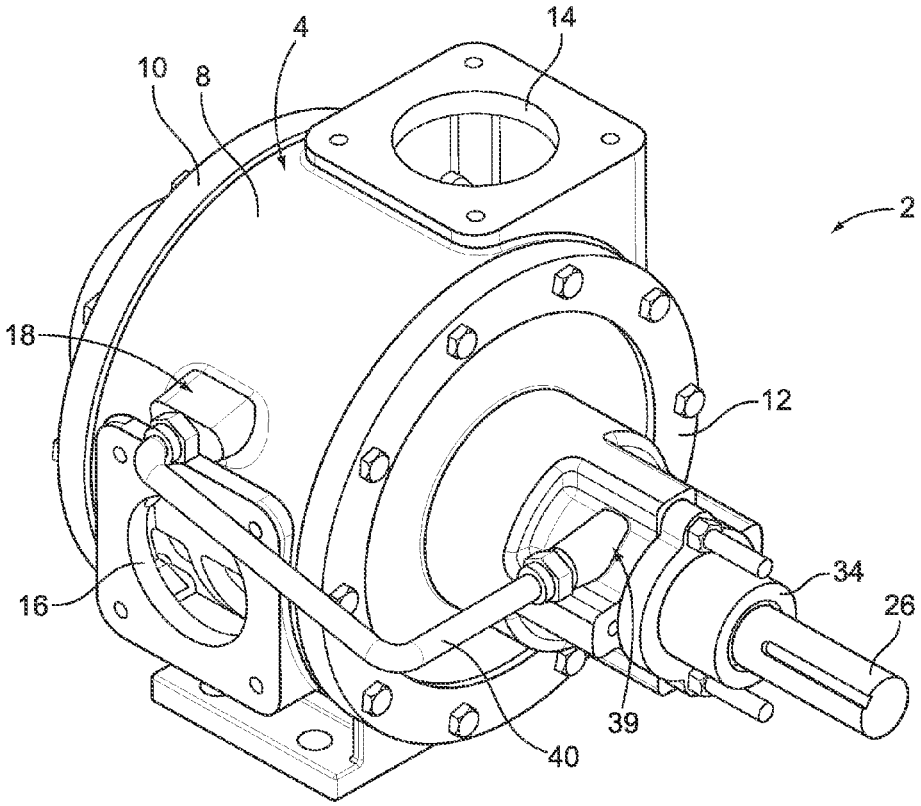
FIG. 2 is a perspective view of the exterior of the sliding vane pump of FIGS. 1A and 1B, showing a conduit that provides an external passage that connects the pumping cavity to a seal chamber of the pump.

In this embodiment, as shown in FIG. 2, the auxiliary pumping port 18 is connected to a conduit 40 that runs externally of the casing 4. The conduit 40 then terminates in a connection at the further port 39 on the casing 4 in the casing rear portion 12, and provides a passage therein that connects the positive-displacement auxiliary pumping port 18 to the seal chamber 36, seen in FIG. 3. While in this configuration the passage within the conduit 40 is used to direct positively-displaced fluid from the pumping cavity 6 to the dynamic, mechanical seal 38 via the port 39 for cooling and lubrication purposes, one will appreciate that the conduit 40 could terminate elsewhere, so as to be used for an entirely separate purpose where a positive-displacement of fluid is needed. In this way, the single pump 2 effectively could be configured to act as two pumps; providing a first relatively large discharge pump and a second relatively small discharge pump. It also will be appreciated that the pump 2 could have included an internally disposed passage through the casing 4.

Returning to FIGS. 1A and 1B to focus on the pumping system, one will see that the rotor 22 is rotating clockwise and the vanes 24 are displaced outward to movably trace the inner wall of the pumping cavity 6. In this manner, the pumping elements 20 move within the pumping cavity 6 and define a collapsing pocket 42, which is shown in as a darkened area within the pumping cavity 6. To simplify the disclosure, one can focus on this one collapsing pocket 42, which in a two-dimensional view is defined by the pumping cavity 6, the rotor 22, a leading movable vane 24A and a trailing movable vane 24B. This collapsing pocket 42 collapses as the volume of the collapsing pocket 42 is reduced due to the rotation of the eccentrically positioned rotor 22.

In FIG. 1A, the leading movable vane 24A has reached a position where it has initially opened the auxiliary pumping port 18 to the collapsing pocket 42, while the trailing movable vane 24B has just closed the discharge port 16 relative to the collapsing pocket 42. Thus, the discharge port 16 is no longer in fluid communication with the collapsing pocket 42 and the auxiliary pumping port 18 will receive positively-displaced fluid from the collapsing pocket 42. As the rotor 22 continues to rotate in the clockwise direction, such as is shown in FIG. 1B, the collapsing pocket 42 continues to collapse and to force fluid from the collapsing pocket 42 in the pumping cavity 6 outward through the auxiliary pumping port 18.

Figure 1B:
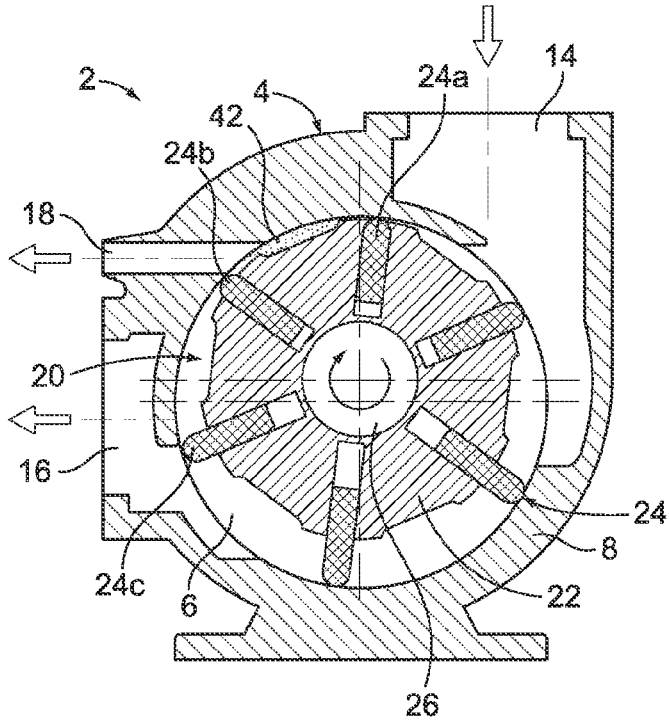
FIG. 1B is a cross-sectional view of the components of FIG. 1A, showing the collapsing pocket in a later position in which it is still in fluid communication with the auxiliary pumping port.

In FIG. 1B, the trailing movable vane 24B has just reached the point at which it is about to open a subsequent collapsing pocket which is bounded at its trailing edge by a movable vane 24C that is closing the subsequent collapsing pocket to the discharge port 16. In this manner, the pump 2 provides a continued stream of positively-displaced fluid for auxiliary purposes. Depending on the particular geometries and placements of the pump components, one can select whether the stream will be relatively continuous or have a somewhat pulsating flow. Also, it will be appreciated that the auxiliary pumping system would still function even if the pump 2 is run in reverse. Thus, the rotor 22 would rotate in a counterclockwise direction, which would still cause positive-displacement of the fluid but would be based on suction through the auxiliary pumping port 18, as the discharge port 16 becomes an inlet port and the inlet port 14 becomes a discharge port.

Turning to a second example embodiment in FIGS. 4A, 4B, 5 and 6, a positive-displacement rotary pump 102 is shown in the form of an internal gear pump having a casing 104 that remains stationary. The casing 104 defines within its interior a pumping cavity 106. The pumping cavity 106 is generally located within a casing body 108 that is closed at respective ends by a casing front portion 110 and a casing rear portion 112. The casing front portion 110 is sealingly connected to the casing body 108, such as by use of a gasket, O-ring or other suitable seal and fasteners. The casing rear portion 112 is connected to the casing body 108, such as by use of fasteners or other suitable connection components.

Figure 4A:
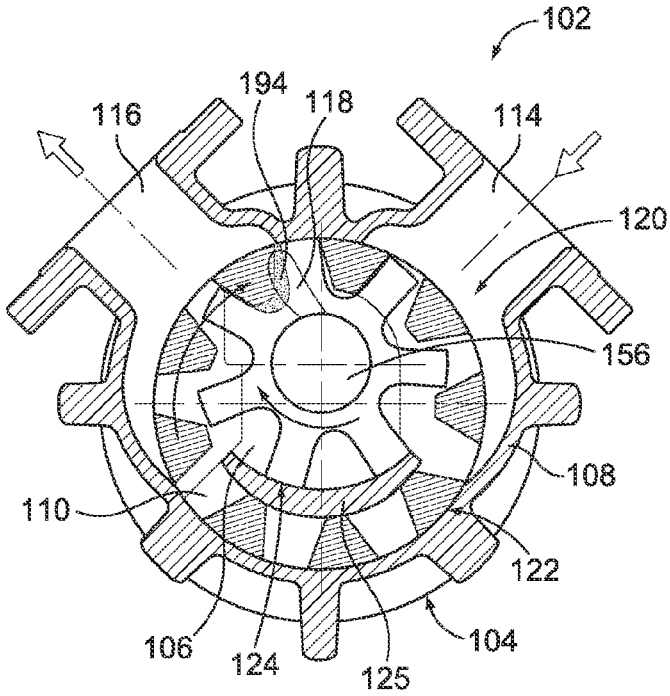
FIG. 4A is a cross-sectional view of a simplified version of an internal gear pump having a positive-displacement auxiliary pumping system and showing a collapsing pocket in fluid communication with an auxiliary pumping port, while the collapsing pocket is no longer in fluid communication with a discharge port.
Figure 6:
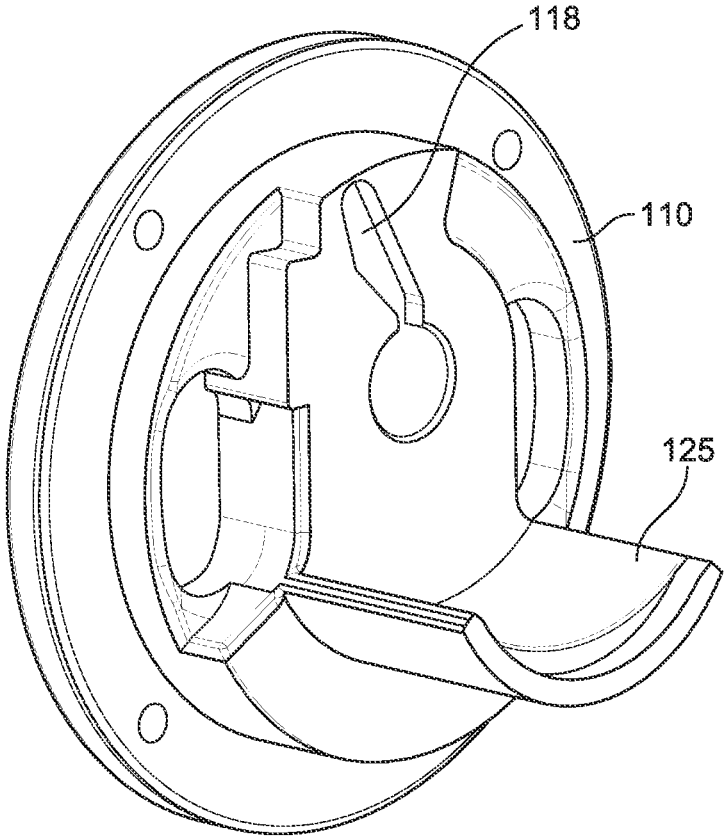
FIG. 6 is a perspective view of the casing end plate of the pump of FIGS. 4A and 4B.

As best seen in FIG. 4A, the casing body 108 of the casing 104 includes an inlet port 114, a discharge port 116 and a positive-displacement auxiliary pumping port 118 that all are connected to the pumping cavity 106. In this embodiment the inlet port 114 and discharge port 116 are formed in the casing body 108 and positioned radially relative to the pumping cavity 106. The auxiliary pumping port 118 is formed in the casing front portion 110, as best seen in FIG. 6, and is positioned axially relative to the pumping cavity 106. One of skill in the art will appreciate that each of the ports 114, 116, 118 could be formed to cooperate via the casing body 108 or the casing front portion 110, and may be positioned radially or axially relative to the pumping cavity 106.

The example pump 102 also includes pumping elements 120 that are disposed within the pumping cavity 106, and which include a rotatable outer gear 122 and a rotatable inner gear 124, with the inner gear 124 being shown as transparent, so as to be able to simplify the drawing and to show the location of the auxiliary pumping port 118. One skilled in the art will appreciate that the inner gear 124 is driven by the meshing action with the outer gear 122, and the crescent-shaped protrusion 125 on the casing front portion 110 is positioned within the pumping cavity, although other drive arrangements and configurations may be utilized. Once again, the embodiments are shown in simplified form, so as to focus on the pumping principles and to avoid including structures that are not necessary to the disclosure and that would over complicate the drawings.

Figure 5:
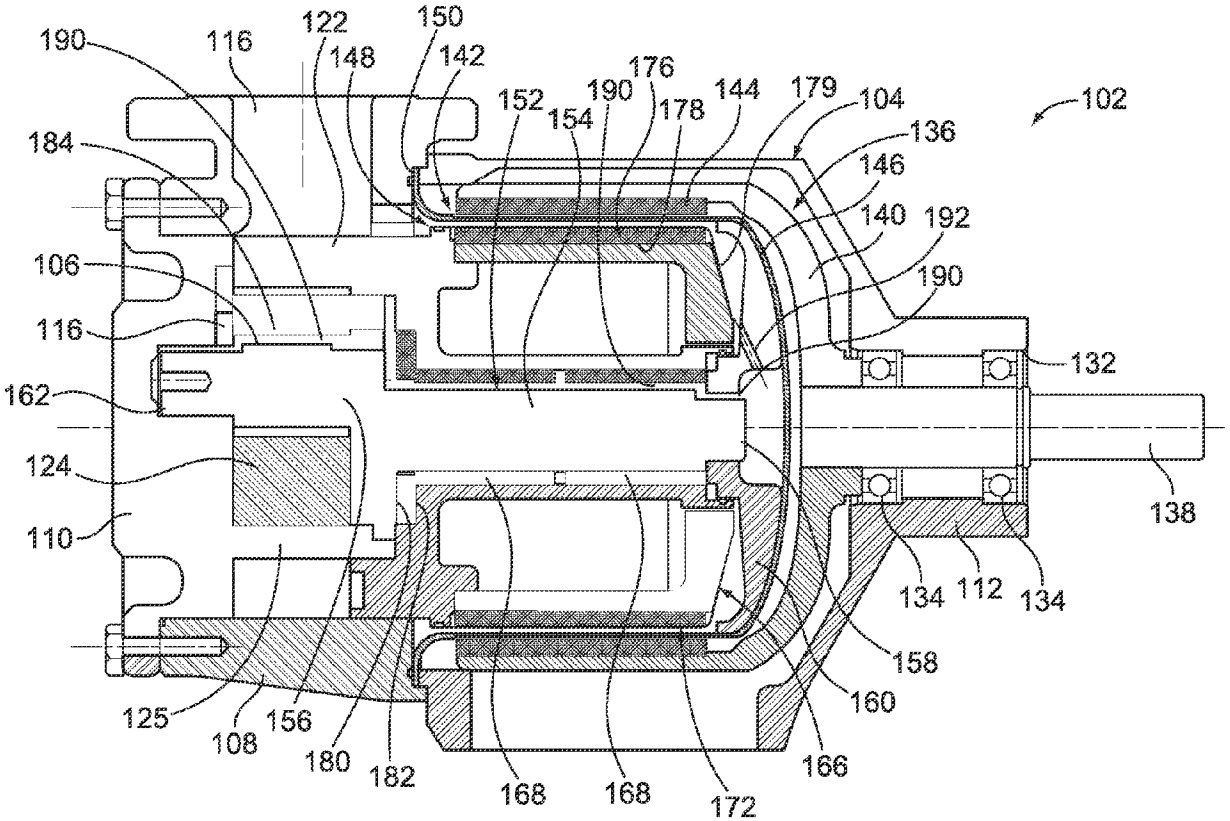
FIG. 5 is a cross-sectional view of the internal gear pump of FIGS. 4A and 4B.

Similar to the first example pump, the components of the casing 104 of the pump 102 may be constructed of rigid materials, such as steel, stainless steel, cast iron or other metallic materials, or structural plastics or the like. Also, the casing front and rear portions 110, 112 may be sealingly connected to the casing body 108 in a similar manner to that described with respect to the first example pump. In FIG. 5, the casing body 108 is shown with a radially oriented discharge port 116 and an axially oriented auxiliary pumping port 118.

The casing rear portion 112 has an opening 132 in which bearings 134 are mounted to support rotatable annular magnetic drive assembly 136. The bearings 134 may be of various constructions, such as ball or roller bearings, bushings or the like, all of which will be referred to as bearings. The annular magnetic drive assembly 136 includes shaft 138 which rotatably engages the bearings 134, and which may be coupled at a first end to an external power source (not shown), such as a motor or the like. The annular magnetic drive assembly 136 also includes a cup-shaped drive member 140 connected at its first end to a second end of the rotatable shaft 138 and having a recess 142 at a second end. Alternatively, a portion of the casing rear portion 112, the bearings 134 and the shaft 138 may be eliminated in favor of mounting the cup-shaped drive member 140 directly on a shaft of an external power source. Similarly, the drive member 140 and shaft 138 may be integrally formed as one piece. The drive member 140 may be constructed of a rigid material, such as that discussed in relation to the casing.

The annular magnetic drive assembly 136 also has magnets 144 connected to the inner wall of the cup-shaped drive member 140 within the recess 142. The magnets 144 may be of any configuration, but are preferably rectangular and are preferably connected to drive member 140 by chemical means, such as by epoxy or adhesives, or may be attached by suitable fasteners, such as by rivets or the like.

Disposed at least partially within the recess 142 of the annular magnetic drive assembly 136 is a cup or bell-shaped separation canister 146. The canister 146 may be constructed of any of a variety of rigid materials, and the material is typically chosen based on the fluid to be pumped, but is preferably of stainless steel, such as alloy C-276, but also may be of plastic, composite materials or the like. The canister 146 is open at one end forming a recess 148 and has a peripheral rim 150. The peripheral rim 150 of the canister 146 may be mounted in sealing engagement to the casing body 108 in various ways, such as referred to above with respect to the connection of the casing body and front and rear portions.

The positive-displacement rotary pump 102 includes an offset stationary shaft 152 having a first shaft portion 154 that is offset relative to a second shaft portion 156. The first shaft portion 154 extends within the recess 148 of canister 146 and may be supported at that respective end 158 of the first shaft portion 154 of the offset shaft 152. Support may be provided to the shaft end 158 by engaging a support plate 160 disposed in the recess 148 of the canister 146, as shown in FIG. 5. Alternatively, if the first shaft portion end 158 is to be supported in the canister, the canister may have an integral support portion. The opposed end 162 of the second shaft portion 156 of the offset shaft 152 is supported in the casing front portion 110.

The pump 102 also includes an annular magnetic driven assembly 166 which rotatably engages the first shaft portion 154 of the offset shaft 152 and may employ friction reducing means such as bearings 168, which in this example are shown in the form of bushings. The annular magnetic driven assembly 166 includes the outer gear 122 disposed around the second shaft portion 156, and a magnetic portion 172 connected to the outer gear 122 either integrally, or by suitable means of fixedly joining the components. The outer gear 122 may be constructed of various rigid materials, depending on the medium to be pumped. For instance, it may be preferable to make the outer gear 122, as well as the magnet mounting portion of steel when such a pump is intended for use in pumping non-corrosive materials.

The magnetic portion 172 includes magnets 176, similar to magnets 144. The magnets 176 are positioned adjacent the outer wall 178 of an annular portion that may be constructed of a rigid material, such as carbon steel or the like. The magnets 176 are held to the outer wall 178 by a stainless steel sleeve 179 that is mounted over the magnets and the annular carbon steel portion for further protection, but it will be appreciated that other means of connection of the magnets 176 may be employed. The magnetic portion 172 is disposed within the recess 148 of the separation canister 146, so as to position the magnets 176 of the annular magnetic driven assembly 166 in separation from the magnets 144 of annular magnetic drive assembly 136 by the separation canister 146, but they are arranged to place the respective magnets 176 and 144 in substantial magnetic alignment to form a magnetic coupling. This magnetic coupling allows the annular magnetic driven assembly 166 to have no physical contact with but be rotated and thereby driven by rotation of the annular magnetic drive assembly 136.

It is desirable for the annular driven magnetic assembly 166 also to have some form of thrust bearing surfaces. As is shown in FIG. 5, a forward thrust bearing surface 180 may be integrally provided on the stationary offset shaft 152, to engage a forward thrust bearing member 182 located in the annular magnetic driven assembly 166. Additional provision for rearward thrust bearings also may be employed, and thrust bearings may be integrally or separately provided to retain appropriate positioning of components to reduce vibration and wear.

Mounted for rotation on the second shaft portion 156 is the inner gear 124. Friction reducing means, such as bearings in the form of bushing 184, may be used for the rotatable mounting of the inner gear 124. The inner gear 124 is arranged to engage the outer gear 122 via a meshing of the gear teeth on the inner gear 124, which is driven by the gear teeth on the outer gear 122. In operation of the pump 102, as the external power source rotates the annular magnetic drive assembly 136, the magnetic coupling discussed above causes the annular magnetic driven assembly 166 to rotate. With the pump 102 arranged as an internal gear pump, as is well known in the art, the axis of rotation of the outer gear 122 is parallel to and spaced from the axis of rotation of the inner gear 124. Rotation of the annular magnetic assembly 166 and the intermeshing of the gear teeth of the outer gear 122 with the gear teeth of the inner gear 124 causes the inner gear 124 to rotate, as well. This arrangement and meshing of gears, along with the crescent-shaped protrusion 125 on the casing front portion 110 being positioned adjacent the tips of the gear teeth on the inner gear 124, cooperate to create the pumping action by well known principles.

In this embodiment, as shown in FIG. 5, the auxiliary pumping port 118 is connected to a passage 190 that runs internally of the casing 104. In this example, the passage 190 effectively includes spacing between components, as well as a through-hole 192 in the support plate 160 within the separation canister 146. The passage 190 and through-hole 192 provide an auxiliary pumping stream that may be used to lubricate components that are subject to friction, as well as to cool components within the separation canister 146. While in this configuration the passage 190 within the casing 104 is used to direct positively-displaced fluid from the pumping cavity 106 to components within the separation canister 146, one will appreciate that alternative passages could be routed differently and terminate elsewhere, so as to be used for an entirely separate purpose where a positive-displacement of fluid is needed. Additionally, as with the first example pump, the pump 102 could be configured to include an external conduit to supply fluid to the pump 102 itself, or to provide an auxiliary, small discharge pump for some other purpose.

Returning to FIGS. 4A and 4B to focus on the pumping system, one will see that the pumping elements 120 are working within the pumping cavity 106. Thus, the outer gear 122 is rotating clockwise and driving the inner gear 124 in a clockwise direction via the meshing of the respective gear teeth. In this manner, the pumping elements 120 move within the pumping cavity 106 and define a collapsing pocket 194, which is shown as a darkened area within the pumping cavity 106. To simplify the disclosure, one can focus on this one collapsing pocket 194, which in a two-dimensional view is defined by the pumping cavity 106, the outer gear 122, and the inner gear 124. This collapsing pocket 194 collapses as the volume of the collapsing pocket 194 is reduced due to the meshing of the gear teeth of the respective gears 122, 124.

In FIG. 4A, one can see that the gears 122, 124 have reached a position in which the auxiliary pumping port 118 is opened to the collapsing pocket 194, while the discharge port 116 is being closed to the collapsing pocket 194 by the outer gear 122. Thus, the discharge port 116 is no longer in fluid communication with the collapsing pocket 194 and the auxiliary pumping port 118 will receive positively-displaced fluid from the collapsing pocket 194. As the outer gear 122 continues to rotate in the clockwise direction, such as is shown in FIG. 4B, the collapsing pocket 194 continues to collapse and to force fluid from the collapsing pocket 194 in the pumping cavity 106 outward through the auxiliary pumping port 118.

Figure 4B:
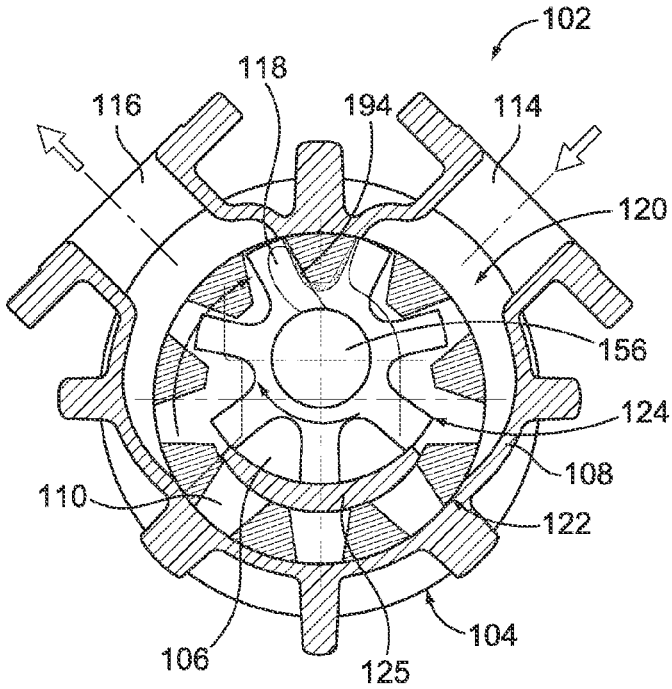
FIG. 4B is a cross-sectional view of the components of FIG. 4A, showing the collapsing pocket in a later position in which it is still in fluid communication with the auxiliary pumping port.

In FIG. 4B, the gear teeth of the inner and outer gears 124, 122 have moved toward a point at which a subsequent collapsing pocket will be opened and the auxiliary pumping port 118 is nearly closed. Based on the repeated cycle of movement, the pump 102 provides a continued stream of positively-displaced fluid for auxiliary purposes. As with the first example pump, depending on the particular geometries and placements of the pump components, one can select whether the stream will be relatively continuous or have a somewhat pulsating flow. Also, it will be appreciated that the auxiliary pumping system would still function even if the pump 102 is run in reverse. Thus, the outer gear 122 would rotate in a counterclockwise direction, which would still cause positive-displacement of the fluid but would be based on suction through the auxiliary pumping port 118, as the discharge port 116 becomes an inlet port and the inlet port 114 becomes a discharge port.

Figure 7A:
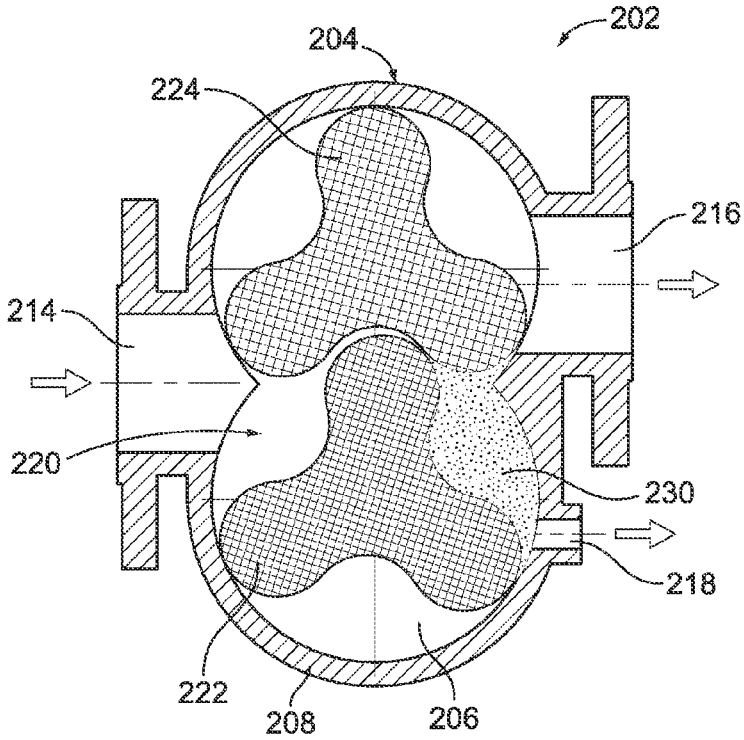
FIG. 7A is a cross-sectional view of a simplified version of a pumping cavity of a lobe pump that has a positive-displacement auxiliary pumping system, and showing a collapsing pocket in fluid communication with an auxiliary pumping port, while the collapsing pocket is no longer in fluid communication with a discharge port.
Figure 7B:
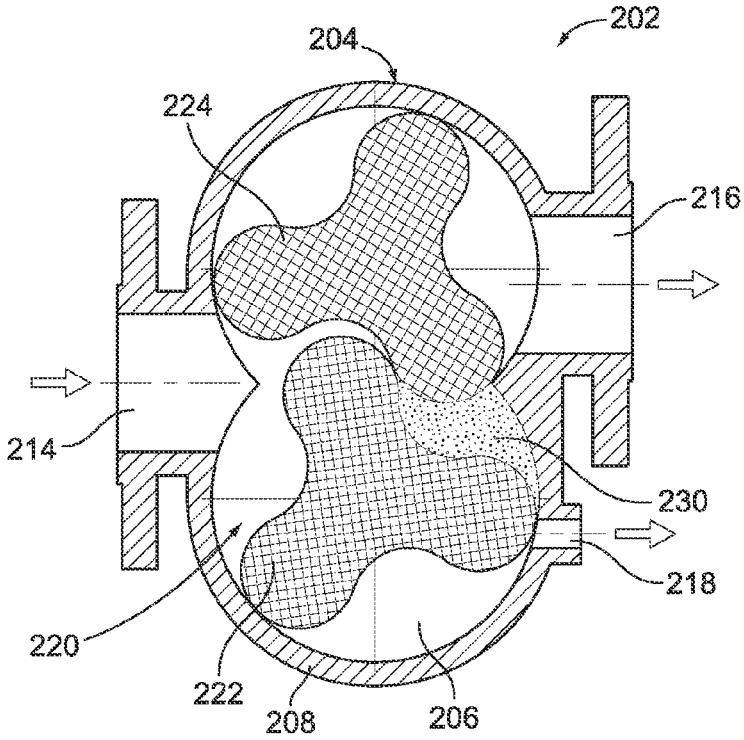
FIG. 7B is a cross-sectional view of the components of FIG. 7A, showing the collapsing pocket in a later position in which it is still in fluid communication with the auxiliary pumping port.

Turning to a third example embodiment in FIGS. 7A and 7B, a positive-displacement lobe pump 202 is shown in the form of a tri-lobe pump having a casing 204 that remains stationary. The casing 204 defines within its interior a pumping cavity 206. The pumping cavity 206 is generally located within a casing body 208 that is closed at respective ends by casing front and rear portions that are sealingly connected to the casing body 208, such as by use of fasteners, adhesives, welding or the like (not shown).

The casing body 208 of the casing 204 includes an inlet port 214, a discharge port 216 and a positive-displacement auxiliary pumping port 218 that all are connected to the pumping cavity 206. In this embodiment the inlet port 214, discharge port 216, and auxiliary pumping port 218 all are formed in the casing body 208 and positioned radially relative to the pumping cavity 206. As with respect to the prior example pumps, it will be appreciated that each of the ports 214, 216, 218 could be formed to cooperate via the casing body 208 or the casing front or rear portions (not shown), and may be positioned radially or axially relative to the pumping cavity 206.

The example pump 202 also includes pumping elements 220 that are disposed within the pumping cavity 206, and which include a first lobe 222 and a second lobe 224, with both lobes 222, 224 being rotatable and shown in tri-lobe configurations. In this type of lobe pump, the lobes 222, 224 typically are supported on separate shafts and driven by timing gears located in an adjacent timing gearbox (not shown). The timing gears are configured to avoid contact between the lobes 222, 224. The components of the casing 204 and pumping elements 220 of the pump 202 may be constructed of materials that are similar to those discussed above with respect to the prior example pumps The pumping action is created by having the lobes come out of mesh and create an expanding volume that draws fluid from the inlet port 214, with the fluid then traveling around the pumping cavity 206 in a collapsing pocket 230 that is shown as a darkened area within the pumping cavity 206 and is formed in the space between the lobes 222, 224 and the walls of the pumping cavity, until the synchronized, non-contacting meshing of the lobes 222, 224 serves to collapse the collapsing pocket 230 and positively-displace the fluid through the discharge and auxiliary pumping ports 216, 218.

The pump 202 is shown only in the simplified cross-section of the casing 204 to focus on the pumping cavity 206, the location of the inlet, discharge and auxiliary pumping ports 214, 216, 218, and on the respective movement of the lobes 222, 224. Thus, this example embodiment is shown in a simplified form, so as to focus on the pumping principles and to avoid including structures that are not necessary to the disclosure and that would over complicate the drawings. As such, one can see that in FIG. 7A, the first lobe 222 is rotating counterclockwise and the collapsing pocket 230 is open to positively displace fluid out the auxiliary pumping port 218, while the second lobe 224 is at a point of rotation at which the discharge port 216 remains closed to the collapsing pocket 230. Thus, in this position, fluid from the collapsing pocket 230 is displaced through the auxiliary pumping port 218 but not through the discharge port 216.

In FIG. 7B, the rotation of the lobes 222, 224 has advanced slightly and one can see that the first lobe 222 is just closing off the auxiliary pumping port 218 with respect to the collapsing pocket 230, but also is just about to open to the auxiliary pumping port 218 with respect to a subsequent collapsing pocket. This is occurring while the second lobe 224 has continued to keep the discharge port 216 closed to the auxiliary pumping port 218. Accordingly, the difference in the volumes represented by the collapsing pocket 230 from FIG. 7A to FIG. 7B represents the volume of fluid that has been positively displaced through the auxiliary pumping port 218.

It will be appreciated that lobe pumps commonly have the inlet and outlet ports directly opposed and positioned to be along an axis that is equidistant from the rotational axes of the lobes. Thus, a common lobe pump would have the collapsing pocket centered with respect to and in fluid communication with the discharge port throughout the rotation of the lobes. However, in this example pump 202, the position of the discharge port 216 does not have its axis centered relative to the rotational axes of the lobes 222, 224, but rather has been moved upward. Also, the auxiliary pumping port 218 has been added to the casing 204 and its axis is not centered relative to the rotational axes of the lobes 222, 224, instead being positioned downward. With this configuration, the collapsing pocket 230 can expel some fluid through the auxiliary pumping port 218 while blocking off the discharge port 216. Indeed, by manipulating the positioning and size of the discharge port 216 and auxiliary pumping port 218, one can select the volume of fluid that will be diverted to the auxiliary pumping port 218.

It should be noted that, as with the prior example embodiments, the description essentially focused on the action with respect to one segment of time within the pumping operation and one collapsing pocket, but the pump 202 would be run for durations that could be treated as operating in a continuous manner. Also, the pump 202 could be operated in reverse and still would positively displace fluid through the auxiliary pumping port 218, but via suction.

It will be appreciated that a positive-displacement rotary pump in accordance with the present disclosure may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such pumps without departing from the scope or spirit of the claimed subject matter, and that the claims are not limited to the preferred embodiments illustrated herein.

What is claimed is:

1. A positive-displacement rotary pump comprising:

a casing defining a pumping cavity;

an inlet port connected to the pumping cavity; a discharge port connected to the pumping cavity;

a positive-displacement auxiliary pumping port connected to the pumping cavity and being smaller in comparison to the discharge port, pumping elements that move within the pumping cavity of the casing and define a collapsing pocket that maintains fluid communication with the positive-displacement auxiliary pumping port after the collapsing pocket is no longer in fluid communication with the discharge port;

wherein the casing configuration includes having the positive-displacement auxiliary pumping port positioned sufficiently proximate the discharge port to permit the positive-displacement auxiliary pumping port to remain in fluid communication with the collapsing pocket immediately following discontinuation of fluid communication between the discharge port and the collapsing pocket;

wherein fluid is positively-displaced through the positive-displacement auxiliary pumping port at a flowrate that is substantially independent of the differential pressure of the pump and/or fluid viscosity; and further comprising a passage that is in fluid communication with the positive-displacement auxiliary pumping port, wherein the passage is configured to direct positively displaced fluid to at least one dynamic seal positioned within the casing, to bearings positioned within the casing and/or to an interior of an annular separation canister positioned within the casing.

2. A positive-displacement rotary pump in accordance with claim 1, wherein the pumping elements further comprise a rotatable rotor having a plurality of movable vanes.

3. A positive-displacement rotary pump in accordance with claim 1, wherein the pumping elements further comprise rotatable gears.

4. A positive-displacement rotary pump in accordance with claim 1, wherein the pumping elements further comprise rotatable lobes.

5. A positive-displacement rotary pump in accordance with claim 1, wherein the inlet port, the discharge port and the positive-displacement auxiliary pumping port all are positioned radially relative to the pumping cavity in the casing.

6. A positive-displacement rotary pump in accordance with claim 1, wherein at least one of the inlet port, the discharge port and the positive-displacement auxiliary pumping port is positioned radially relative to the pumping cavity in the casing.

7. A positive-displacement rotary pump in accordance with claim 1, wherein at least one of the inlet port, the discharge port and the positive-displacement auxiliary pumping port is positioned axially relative to the pumping cavity in the casing.

8. A positive-displacement rotary pump in accordance with claim 1, further comprising:

a rotatable annular magnetic drive assembly having a recess with an opening at one end;

an annular separation canister having a recess with an opening at one end, and at least a portion of the annular separation canister being disposed within the recess of the rotatable annular magnetic drive assembly, an annular magnetic driven assembly having a magnetic portion disposed substantially within the recess of the annular separation canister, and the magnetic portion being substantially in magnetic alignment with the rotatable annular magnetic drive assembly; and wherein the annular magnetic driven assembly is connected to a rotor gear that drives an idler gear.

9. A positive-displacement rotary pump in accordance with claim 8, wherein the pumping elements are the rotor gear and the idler gear.

10. A positive-displacement rotary pump in accordance with claim 1, wherein the positive-displacement auxiliary pumping port is connected to a conduit that runs external to the casing.

11. A positive-displacement rotary pump in accordance with claim 10, wherein the conduit is connected at a first end to the positive-displacement auxiliary pumping port and is connected at a second end to a further port on the casing.

12. A positive-displacement rotary pump in accordance with claim 1, wherein the casing further comprises a casing body that is connected to a casing front portion and a casing rear portion.

* * * * *